US006832813B2

(12) United States Patent
Tomas et al.

(10) Patent No.: US 6,832,813 B2
(45) Date of Patent: Dec. 21, 2004

(54) BOOSTER SEAT HAVING RETRACTABLE SECURING MECHANISM AND METHOD OF USING

(75) Inventors: Jorge Tomas, Wrentham, MA (US); J. Michael Treen, Jamaica Plain, MA (US); Michael T. Fusco, Johnston, RI (US); Brian Sundberg, Chester, NH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/689,962

(22) Filed: Oct. 21, 2003

(65) Prior Publication Data

US 2004/0084938 A1 May 6, 2004

Related U.S. Application Data

(63) Continuation of application No. 10/241,608, filed on Sep. 11, 2002, now Pat. No. 6,773,064.
(60) Provisional application No. 60/322,404, filed on Sep. 14, 2001.

(51) Int. Cl.[7] ..... A47D 1/10
(52) U.S. Cl. ..... 297/250.1; 297/475
(58) Field of Search ..... 297/250.1, 468, 297/474, 475; 242/382–383.5, 396–396.4

(56) References Cited

U.S. PATENT DOCUMENTS 1,739,366 A * 12/1929 Lang ..... 297/37
1,967,533 A * 7/1934 Koop ..... 297/183.5
5,183,311 A * 2/1993 Meeker et al. ..... 297/151
5,383,708 A * 1/1995 Nagasaka et al. ..... 297/250.1
5,439,253 A * 8/1995 Trubiano ..... 280/801.1
5,605,375 A * 2/1997 Friedrich et al. ..... 297/250.1
5,611,603 A * 3/1997 Gray et al. ..... 297/476
5,839,789 A * 11/1998 Koledin ..... 297/476
6,692,072 B2 * 2/2004 Nelson et al. ..... 297/250.1
2002/0043836 A1 * 4/2002 Maciejczyk et al. ..... 297/250.1

FOREIGN PATENT DOCUMENTS

GB 0369693 A2 * 5/1990

* cited by examiner

*Primary Examiner*—Peter M. Cuomo
*Assistant Examiner*—Joseph Edell
(74) *Attorney, Agent, or Firm*—Barnes & Thornburg LLP

(57) ABSTRACT

The present disclosure relates to a booster seat configured to carry a child and adapted to be supported by at least one of a chair and seat. The booster seat includes a base portion and at least one rotatable spool connected with the booster seat. Also included is at least one spool strap having one end windable about the at least one rotatable spool and having a first connector at a free end of the at least one spool strap, the free end extending outside the booster seat. Further included is at least one associated second connector connected with the booster seat to connect with the first connector to secure the booster seat to the at least one of a chair and seat. The present disclosure also relates to a method for securing the booster seat to a support and a method of unsecuring the booster seat and storing the spool straps and connectors.

44 Claims, 8 Drawing Sheets

BOOSTER SEAT HAVING RETRACTABLE SECURING MECHANISM AND METHOD OF USING

CROSS-REFERENCE

This continuation application claims the benefit of non-provisional application Ser. No. 10/241,608 filed Sep. 11, 2002 entitled BOOSTER SEAT now U.S. Pat. No. 6,773,064, which disclosure is incorporated herein by reference, and claims the benefit of provisional application Serial No. 60/322,404 filed Sep. 14, 2001 and entitled BOOSTER SEAT, which disclosure is incorporated herein by reference.

BACKGROUND

Seats made to hold children and the placing of those seats on some type of chair or other support are known.

This disclosure relates to booster seats and more particularly is directed to a portable booster seat that is convenient, safe and durable.

SUMMARY

In accordance with an aspect of the present disclosure, retractable straps are incorporated into the device that may typically be used to extend under the seat of a chair as well as around the back of the chair on which the booster is used. The retractable nature of the straps assures that they will not be lost, and the straps also include a connector or buckle arrangement for easy connection and release by an adult.

The retractable straps or strap system, in accordance with one embodiment of the disclosure, is built into or connected with a base or base portion of the booster seat. The booster seat includes at least one rotatable spool, having at least one strap windable about the spool. The windable strap extends under and around a seat of a chair on which the booster seat is used and another such strap may extend about or around a backrest of the seat or chair, with each windable strap connecting with a connector to secure the booster seat to the chair or seat. In accordance with an embodiment of the disclosure, the at least one rotatable spool includes two rotatable spools that are operatively connected so that the winding of one spool to retract its strap will also cause the other spool to rotate and retract the second strap, assuming that both straps are extended. The windable straps and connectors are storable when the booster seat is not in use.

The adjustable restraint in accordance with one embodiment of the disclosure includes a crotch strap that extends upwardly from the center of the front portion of the seat as well as a pair of safety straps separately connected to the sides of the seat and that buckle to the crotch flap. An easy buckle arrangement joins the three straps together so that an adult attending to the child in the seat may easily lift the child with one hand and release the buckle with the other.

The disclosure will be better understood and appreciated from the following detailed descriptions and with reference to the accompanying drawings.

DETAILED DESCRIPTION OF THE DRAWINGS

Figure 1:
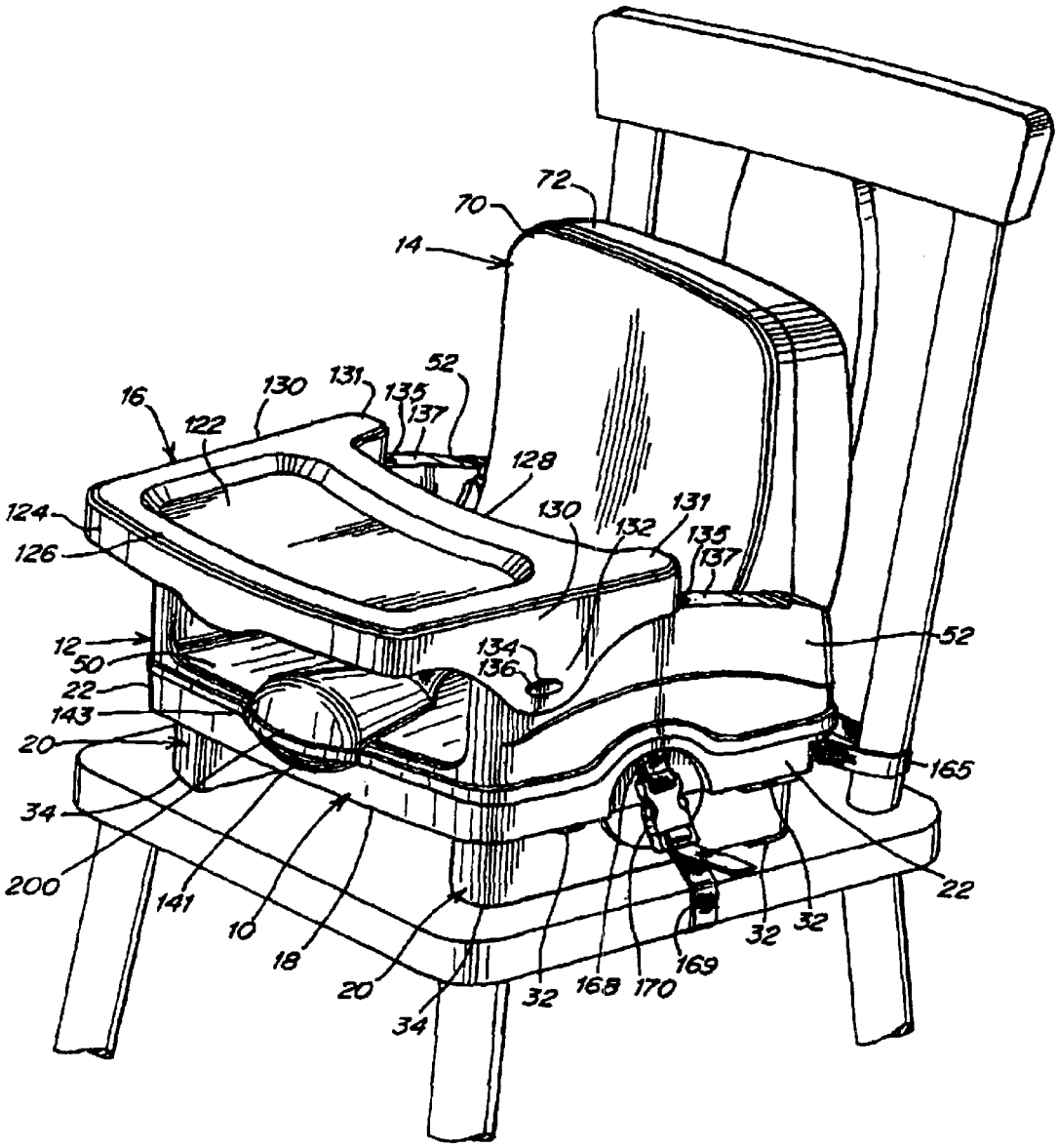
FIG. 1 is a perspective view of a booster seat embodying the present embodiment mounted on a chair and with the booster seat legs extended so as to elevate the seat for use by a younger child, and with the tray in the operative position.

The booster seat shown in one preferred embodiment illustrated in the drawings includes a base or base portion 10, seat 12, backrest 14 and tray 16. In accordance with one aspect of this disclosure, the elements identified above are injection molded of a plastic material such as polypropylene, but it is to be understood that the various parts of the booster seat may be wade of different materials and by different forming processes.

Figure 2:
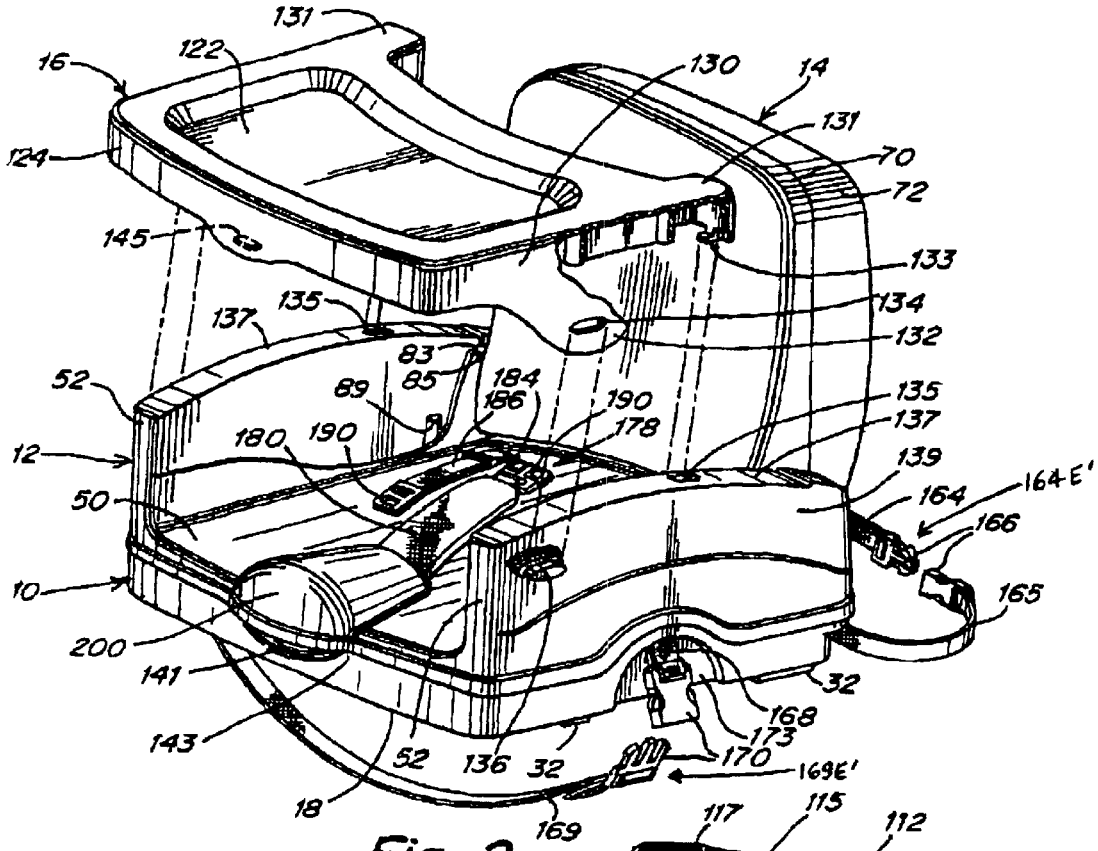
FIG. 2 is a partially exploded, perspective view of the booster seat shown in FIG. 1, but with its legs collapsed to accommodate an older child, and with the tray detached.

In accordance with one aspect of the illustrated embodiment, the base 10 supports a pair of legs 20 that extend front to back adjacent sides 22 of the base. In this embodiment, the legs are supported for pivotal motion adjacent their front and rear ends, 26, 28 respectively, so as to enable the legs to move from an active or operative position as shown in FIG. 1, wherein the legs 20 extend downwardly so as to elevate the base 10 above the supporting surface on which the booster seat rests, and an inactive or collapsed position wherein the legs 20 are disposed in the base 10 as shown in FIG. 2 so as to enable the base 10 to sit directly on the supporting surface on which it rests to lower the seat 12. Preferably, both the bottom surface 18 of the base 10 and the lower edges 34 of the legs 20 carry gripper feet 32 that will restrain slipping of the booster seat on its supporting surface whether or not the legs 20 are deployed.

Figure 12:
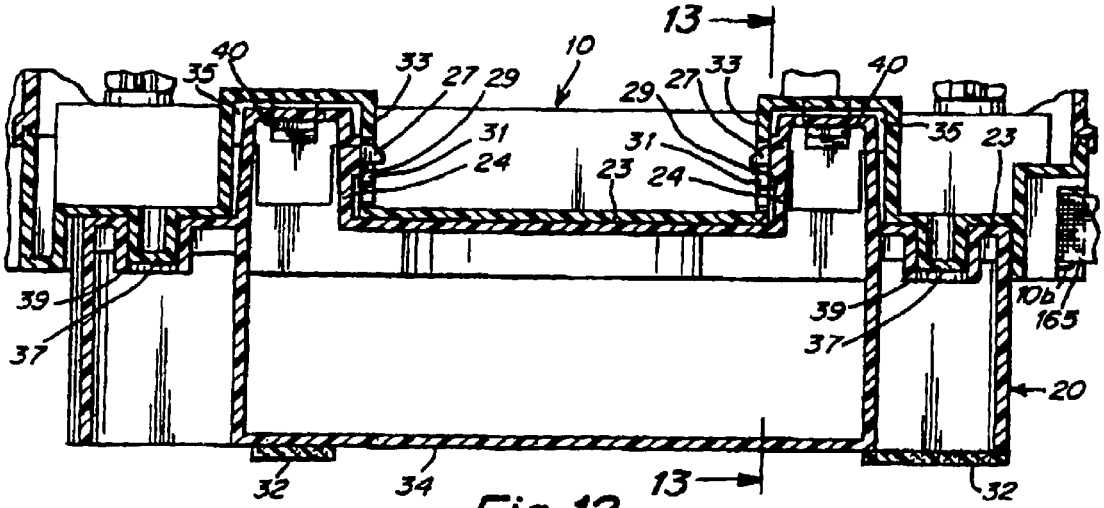
Figure 13:
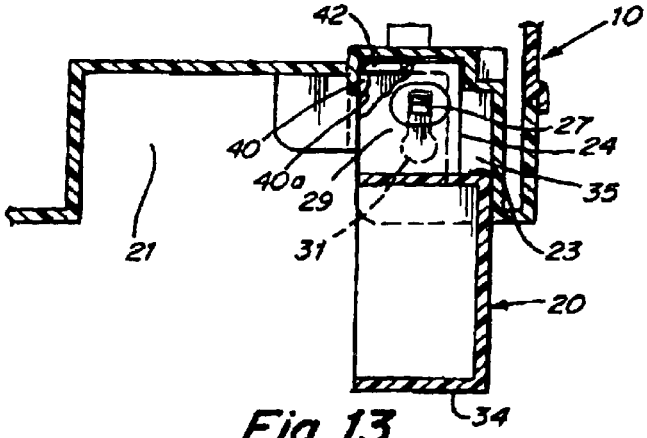
FIG. 13 is a fragmentary cross-sectional view taken along section line 13—13 in FIG. 12 with a leg in the operative position.
Figure 14:
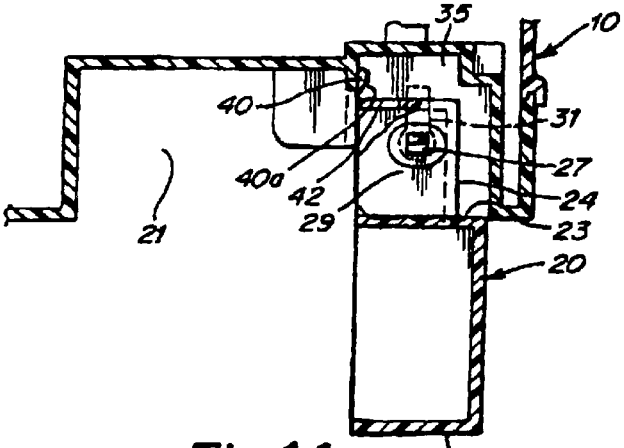
FIGS. 14–16 are fragmentary cross-sectional views similar to FIG. 13 and FIG. 11, respectively, but showing the sequence of the positions of the leg as it moves from the operative to the collapsed position stored in the base.

As is shown in FIGS. 6, 7, 10, 11 and 13–16, cavities 21 are provided in the bottom surface of the base 10 for receiving the legs 20 when folded to their inactive positions, The mounting arrangement for the legs 20 in the embodiment illustrated is shown in detail in FIGS. 11–16. The legs 20 on their upper surface 23 carry a pair of extensions 24 with lugs 27 on their opposed walls 29 that are disposed in keyhole slots 31 provided in the adjacent sides 33 of cavities 35 that receive the extensions 24. When the legs 20 are in their deployed positions as in FIG. 12, lugs 27 will be at the tops of the slots 31 as shown in FIGS. 12 and 13. However, when the legs 20 are in their stored position in the cavities 21, the lugs 27 serve as pivots in the enlarged lower ends of the keyhole slots 31 (see FIGS. 14–16) that enable the legs 20 to swing through 90° between the stored and deployed positions. When the legs 20 are pivoted to their deployed position, they can move up and down translationally with the lugs 27 in the keyhole slats 31 so that posts 37 carried on the base 10 may be brought into registration with sleeves 39 in the upper surface 23 of the legs 20 to hold the legs 20 firmly in the vertical deployed position.

Figure 7:
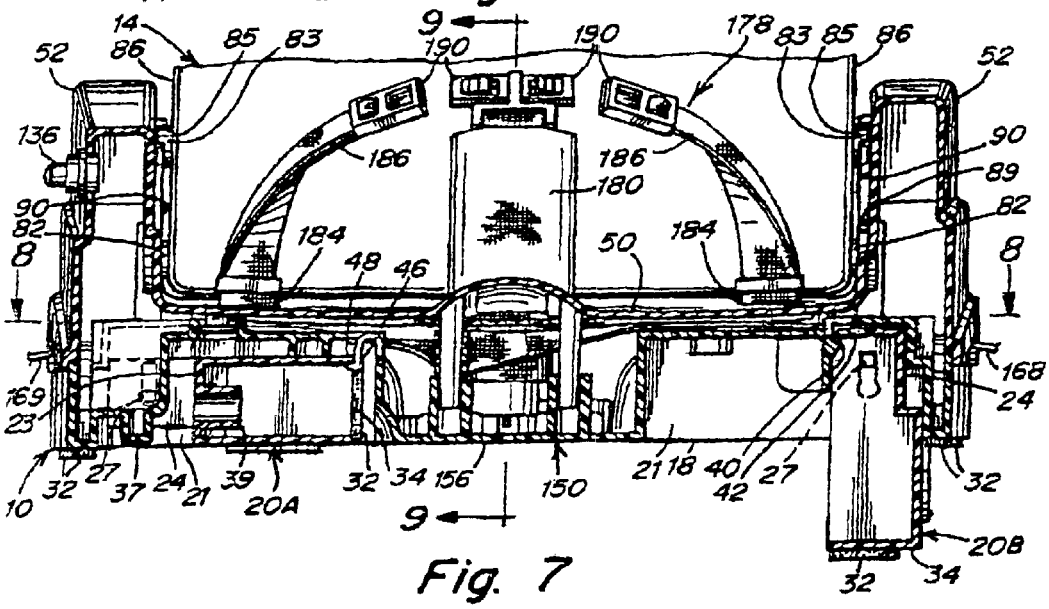
FIG. 7 is a cross-sectional elevation view of the booster seat taken along section line 7—7 in FIG. 6.

In the embodiment shown, a flange 40 on the base 10 engages the edge 42 of the top of each extension 24 (see FIG. 13) to hold the leg 20 in the elevated position with the posts 37 and sleeves 39 in registration with one another (see right leg 20B in FIG. 7). When the leg 20 is to be pivoted to the stored position, edge 42 snaps past the flange 40 and releases the edge of the extension so that the leg 20 can be lowered, disconnecting the post 37 and sleeves 39, and lugs 27 move to the bottom of the keyhole 31 slot to allow the leg 20 to then pivot to the stored position (see FIGS. 15 and 16). It will be noted that a ramp 40*a* is provided on the bottom of the flange 40 to enable the edge 42 to ride up over the flange 40 when the leg 20 is deployed.

Figure 15:
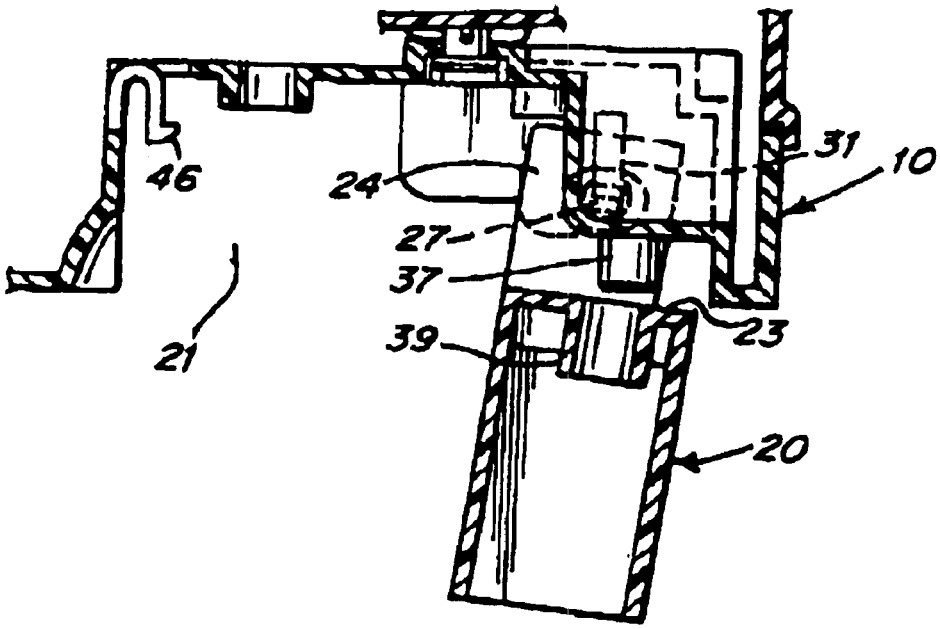
Figure 16:
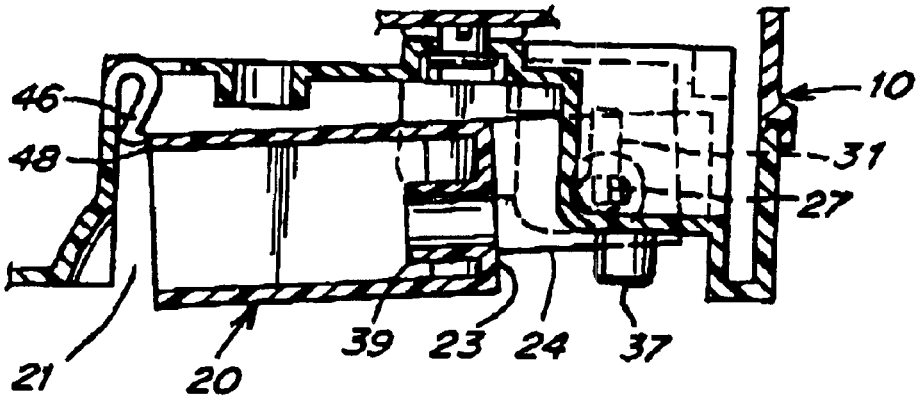

A friction fit may also exist between the posts 37 and the sleeves 39 as an alternative or in addition to the flanges 40 to releasably hold the legs 20 in the operative position. It will be appreciated that when the child's weight is applied to the booster seat, it will exert a force on the booster seat to further maintain the connection between the posts 37 and sleeves 39. In FIGS. 15 and 16 a hook-like spring catch 46 is shown in the cavity for releasably latching onto the edge 48 of the leg 20 to hold it in the stored position. The leg 20 may be freed by overcoming the catch 46. In the preferred embodiment two such catches 46 are employed, one adjacent each end of each of the two legs 20.

The seat 12 shown in FIG. 2 which together with the base 10 forms a bottom member for the booster, has a contoured surface 50 for the comfort of the child and includes a pair of upstanding arms 52 ruining front to back along the sides thereof. In the illustrated embodiment of the disclosure, the seat 12 and base 10 are separately fabricated and later connected together. The two may be releasably or permanently locked together by barbs and openings, nuts and screws, poppet-type connectors, ultrasonic welding or by other means. In normal use the two may be treated as a single member. The arms 52 of the seat in the embodiment shown are rigidly connected with respect to the seating surface 50, but it is to be understood that the arms 52 may also be separately fabricated and connected together.

Figure 4:
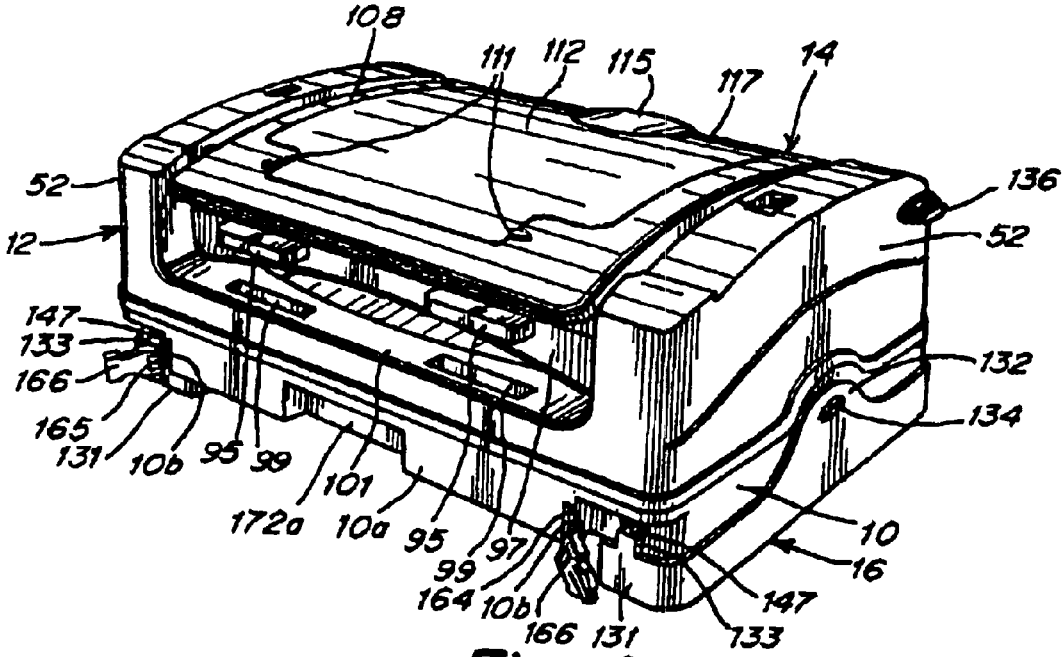
FIG. 4 is a rear perspective view of the collapsed booster seat with the storage compartment closed.
Figure 9:
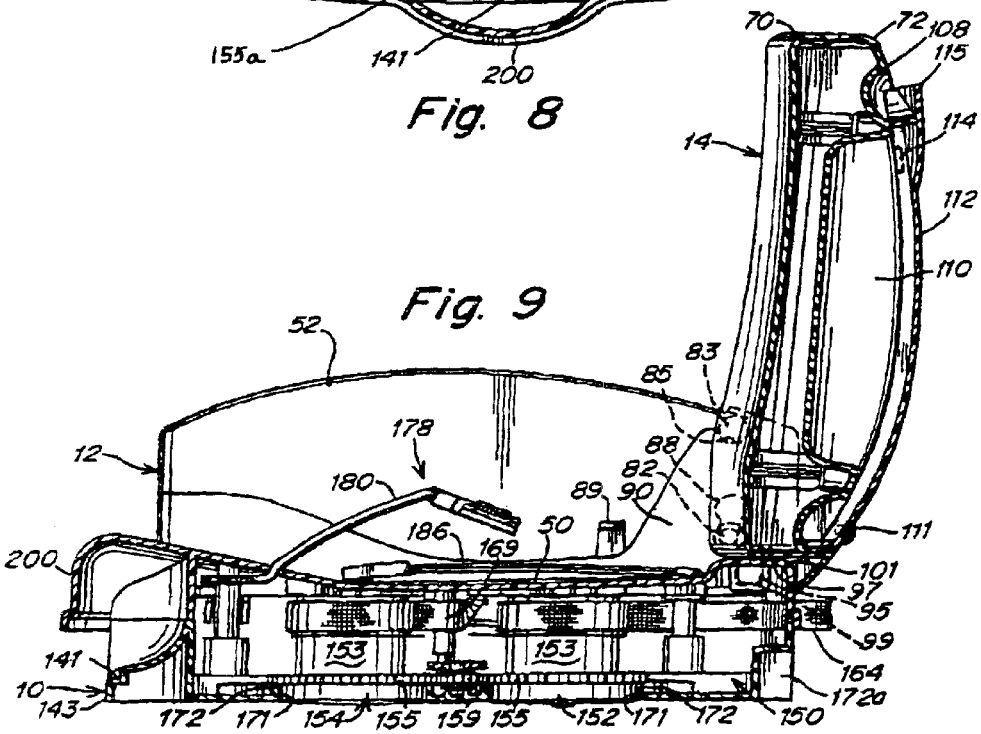
FIG. 9 is a cross-sectional side view of the booster seat with the backrest elevated, taken along section line 9—9 in FIG. 7.
Figure 10:
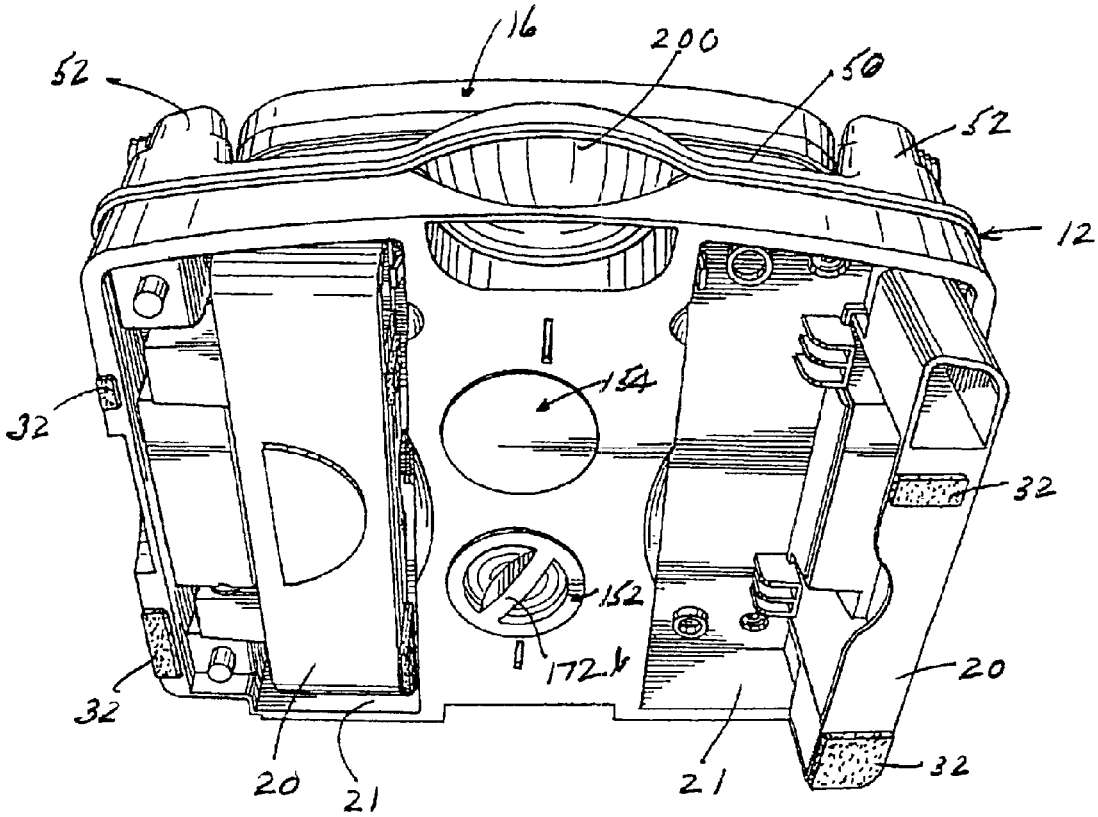
FIG. 10 is a bottom perspective view of the booster seat showing one leg in the operative position and the other in the collapsed position within the base.
Figure 11:
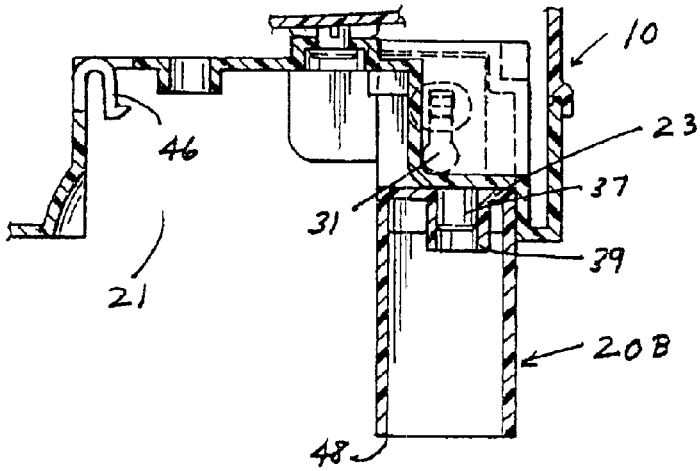
FIGS. 11 and 12 are fragmentary cross-sectional views taken along the sections lines 11—11 and 12—12 in FIG. 6.

The back 14 in the embodiment shown and in accordance with another aspect of the disclosure comprises a front portion 70 and a rear portion 72 that may be molded separately and secured together by fasteners (not shown) such as snap fasteners and slots on the front and rear portions, or by any other expedient such as suggested above to connect the base 10 and seat 12. Once connected together, the front and rear portions would not ordinarily be separated and therefore the fasteners may be of substantial size and stiffness so as to make it difficult to separate the two. The assembled back 14 carries a pair of axles 82 extending from its sides 86, that are received in keyhole-shaped openings 88 on the insides 90 of the arms 52 at the rear thereof, as shown in FIGS. 7 and 9. It will be noted that the openings 88 are vertically elongated so as to enable the axles 82 and thus the backrest 14 to be elevated on the arms 52. The sides of the backrest 14 also carry posts 83 that extend outwardly therefrom and fit within slots 85 formed in the inner surfaces of the arms 52 and open in an upwardly and forwardly direction as also shown in FIG. 9. To further support the backrest 14 in the operative position, one or more flanges 95, (two are shown in FIG. 4) may be provided along the bottom edge 97 of the backrest 14 that register with corresponding recesses 99 along the rear 101 of the seat 12. When the seat is placed in the operative position, the flanges 95 are disposed in the recesses 99 and further assist in holding the backrest 14 erect. Before the backrest 14 can be pivoted to the collapsed position, the flanges 95 must be withdrawn from the recesses 99 as the posts 83 are freed from the slots 85. When the backrest 14 is elevated to free the posts 83 and flanges 95, it may be pivoted to a position spaced a short distance above and substantially parallel to the surface 50 of the seat 12. To releasably retain the backrest in the folded position, short snap-type flanges 89 (one shown in FIG. 2) are formed in the lower rear portion of the arms 52 to engage the posts 83. The backrest 14 is retained in the upright position by virtue of the shape of the slots 85 that are somewhat narrowed at their openings so that the posts 83 snap in and out of them.

The similarity of the pivotal actions of the backrest 14 and the legs 20 in the illustrated embodiment will be recognized. Both are pivotally mounted, but both also move translationally as well, to achieve the stored and deployed positions. It should be appreciated that other arrangements may be employed to enable the backrest 14 and legs 20 to be moved between the deployed and stored positions and to be retained in those positions. As one alternative arrangement, the legs 20 and the backrest 14 may be detachably connected to the base 10 and/or seat 12 and be disconnected from them when their positions are to be changed. Snaps or other types of connectors may be used to hold the legs 20 and the backrest 14 in their alternative positions and release them when their positions are to be changed. Other arrangements may be used as well.

Figure 3:
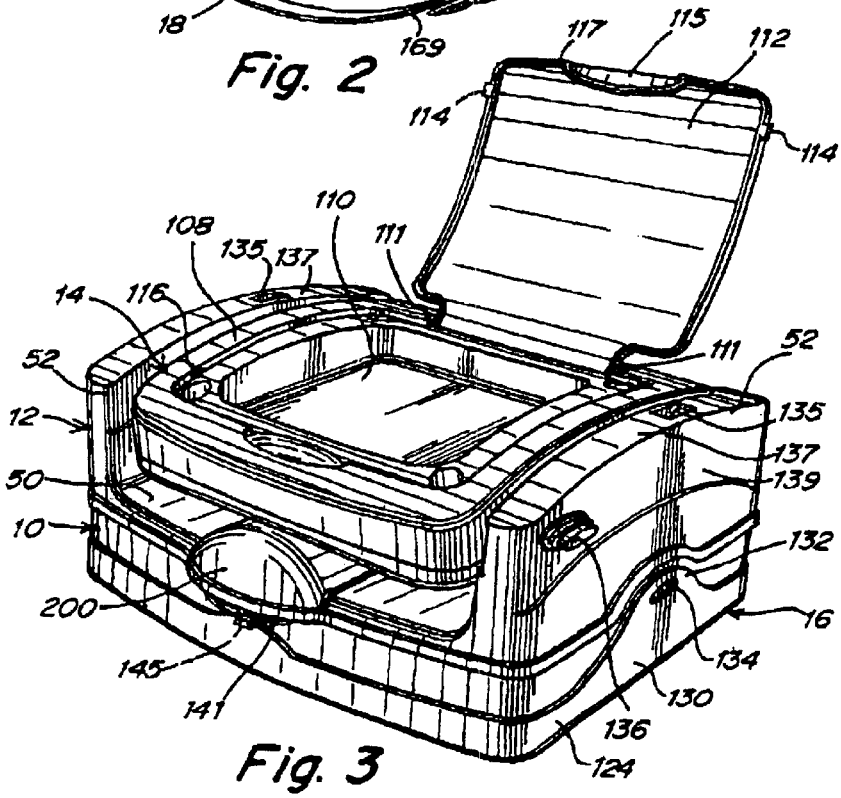
FIG. 3 is a front perspective view of the booster seat in a collapsed configuration with the tray attached to the bottom for storage or travel and showing the storage compartment in the backrest open.

In accordance with another aspect and as shown in FIGS. 3 and 9, the rear surface 108 of the backrest 14 may include a storage compartment 110 that is covered by a lid 112. The storage compartment 110 provides a convenient location for keeping sundry items in the booster seat, particularly when it is moved from one location to another. In FIG. 3, the lid 112 is shown in the open position revealing the storage area. While the lid 112 is shown hinged to the back at 111 by pins carried at its corners and slots in the backrest 14 (see FIG. 3), it may alternatively be removably mounted on the backrest 14 and simply snap onto the backrest 14 in the closed position, Preferably however, the lid 112 is hinged to the backrest 14 so that it will not be misplaced. In the embodiment illustrated, flanges 114 are provided on the lid 112 and slots 116 on the backrest 14 to releasably hold the lid 112 in the closed position, and a convenient finger grip 115 is provided in a free edge 117 of the lid 112 to grasp it to overcome the latch so as to open the compartment 110. The flexibility of the material from which the lid 112 is made enables it to bow slightly so that the flanges 114 can snap in and out of the slots 116. Other expediences may be used for that purpose as well.

In accordance with yet another aspect, the removable tray 16 performs a dual function, namely, it serves as a conventional tray to hold food, toys, etc. for a child occupying the booster seat, and alternatively serves as a bottom cover for the base 10 to enclose the legs 20 and other operative parts of the booster seat as well when in the stored position. The latter position is most convenient when the booster seat is stored or being carried about. Shown in its tray functioning or use position in FIG. 1, tray 16 includes a shallow recess 122 in its upper surface to retain items placed on the tray such as toys, dishes, cups, and other sundry products. The tray has a peripheral skirt 124 that extends downwardly along the front and back edges 126 and 128 thereof as well as along the sides 130. The rear corners 131 of the skirt 124 carry connectors 133 (one shown in FIG. 2) in the form of hooks that extend into openings 135 on the upper surfaces 137 of the arms 52 and under the margins thereof to retain the rear of the tray 16 in operative position. The skirt 124 along the sides 130 also includes extensions 132, each having an opening 134 that receives the tray locks in the form of bosses 136 on the outside surfaces 139 of the arms 52. While the openings 134 and bosses 136 are shown as being elliptical, obviously, they may be of other shapes. In accordance with one aspect of the disclosure, the bosses 136 may be spring biased to the extended position shown in FIG. 2 but may be depressed so as to lie within the arms 52 to enable the tray skirt 124 to be mounted in position over the arms 52 with the openings 134 engaging the bosses 136. Once aligned with the bosses 136, the locks under the influence of the springs (not shown) extend the bosses 136 into the openings 134 to retain the tray 16 in place. The tray may readily be removed by depressing the bosses 136 to free the extensions 132 of the skirt 124 from them. Other attaching and locking means may be employed as well, but whatever means is used must dependably hold the tray 16 firmly in place so that it will not accidentally detach from or tilt with respect to the seat and spill the tray contents on the floor or allow the child in the booster seat to fall out of the seat. As one alternative construction, the extensions 132 of the tray skirt 124 may possess sufficient flexibility to allow one or both to be bowed outwardly so as to snap over fixed bosses (rather than being spring loaded) or any other type of connector on the arms 52.

Figure 5:
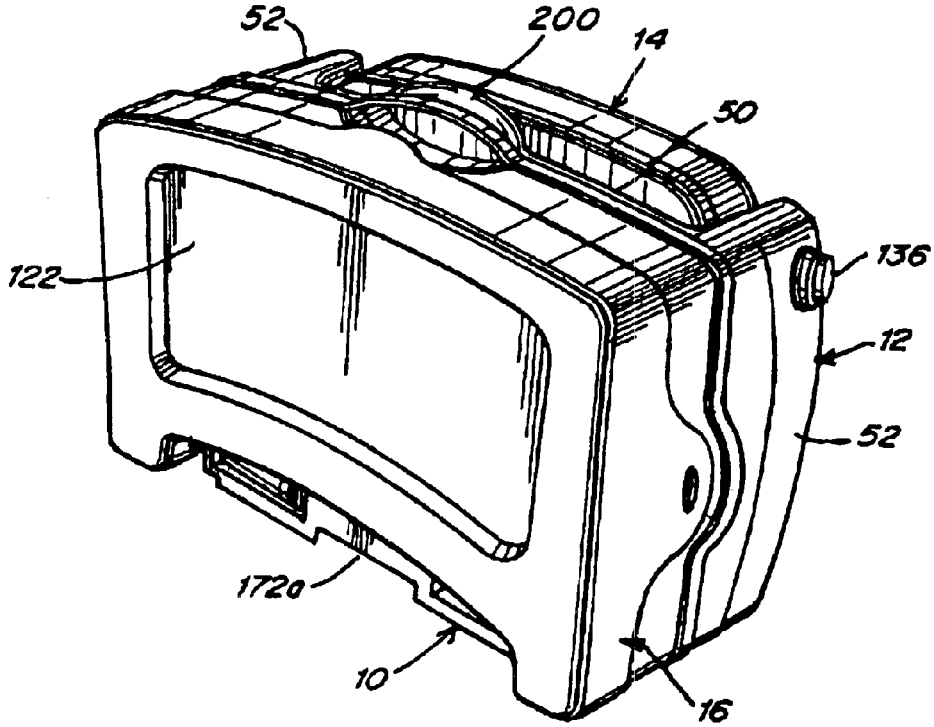
FIG. 5 is a bottom perspective view of the collapsed booster seat in the carrying position.

The alternative or stored position for the tray 16 is shown in FIGS. 3–5 attached 20 to the bottom of the base 10 covering the surface 18 to enclose the folded legs 20 and other parts of the booster seat as described below. The openings 134 of the tray 16 when the tray 16 is mounted on the bottom of the base 10 may receive bosses or other forms of latches to hold the tray 16 in place much like the bosses 136 on the arms 52 but carried on the sides of the base 10. Alternatively, fasteners in the form of flanges on the tray 16 may releasably engage steps or recesses in the base 10 to serve that purpose. In FIGS. 2, 3, and 9 a step 141 is shown at the center of the front edge 143 of the base 10 positioned to receive flange 145 carried on the inside of the tray skirt 124 at the front thereof to hold the front side of the tray 16 in position on the bottom of the base 10. At the rear side of the base 10 (see FIG. 4), a pair of recesses 147 are provided that receive the hooks 133 at the rear corners of the tray 16 to hold the back of the tray 16 in place on the base 10. These latching devices are releasable because of the flexibility of the plastic so that the tray 16 can be removed from and be replaced on the base 10. Other latching arrangements may be used as well. When the tray 16 is mounted on the base 10, it provides a smooth, even surface for the booster when placed on a chair or other surface with the legs 20 retracted, and as indicated, also conveniently stores in that position.

Figure 8:
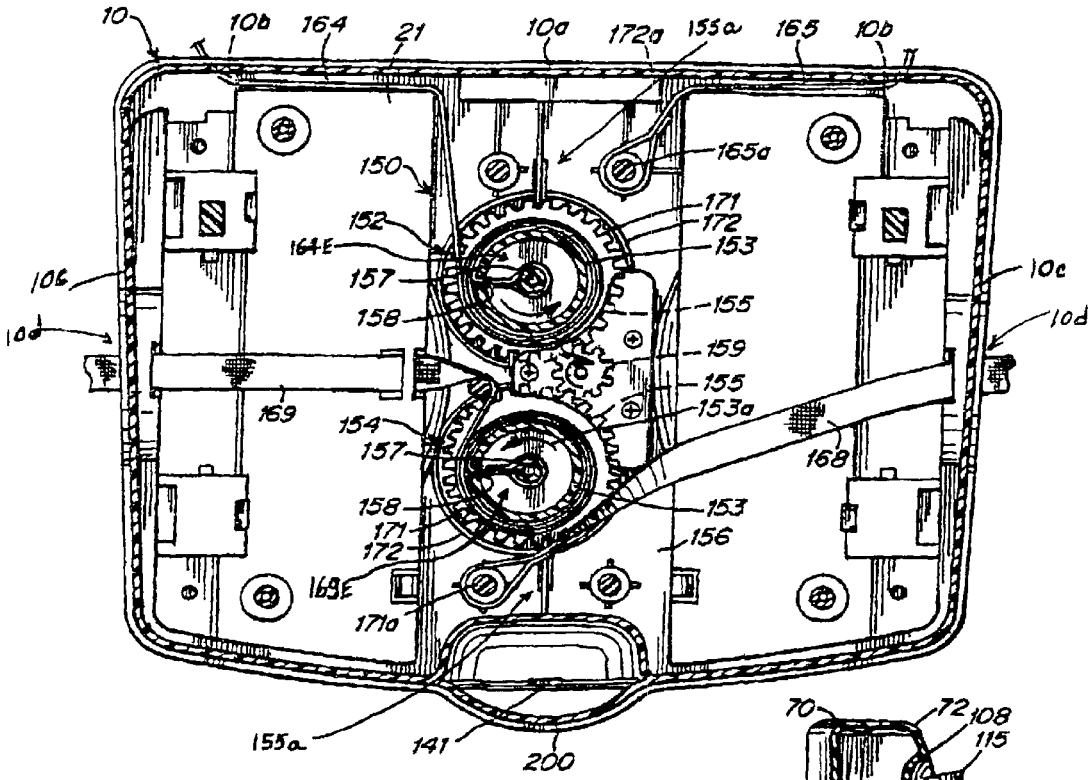
FIG. 8 is a cross-sectional top view of the booster seat taken along section line 8—8 in FIG. 7.

In accordance with yet another aspect, a retractable strap system or assembly having at least one strap 164 or 169, connected with at least one retractor 152, 154 is provided to securely attach the booster seat to a chair or other support on which it is placed when in use (see FIG. 8). Another respective strap 165 or 168 may also be connected with the booster seat and mates with a respective strap 164 or 169. All the straps 164, 165, 168, 169 may have a connector, such as 166 or 170 attached to outer, free ends of each strap, with the position of the connector 166 or 170 being adjustable on at least one of the straps 164, 165, 168, 169. One or more of the straps 164, 165, 168, 169 may extend about the back and/or the support on which the booster seat rests. In FIGS. 6–9, the base 10 is shown to include a housing 150 that runs from front to rear along a central portion of the base 10. The housing 150 carries the pair of retractors 152 and 154 on the bottom wall or surface 156 of the housing 150, and the retractors 152, 154, carry the straps 164, 169 for securing the base 10 of the booster seat on, for instance, a chair with which the booster seat is used. The retractors 152 and 154 each include a spool 153 about which the straps 164, 169 are wound (see FIG. 8). A gear 155 on the bottom of each spool 153 is configured to operatively connect the two spools 153 together. A post 157 is coaxially mounted within each spool 153 for connecting an end 164E, 169E of straps 164, 169. An axially extending slot 158 in the spool 153 wall through which the ends 164E, 169E of the straps 164, 169, respectively, extend to connect to the posts 157. The gears 155 are operatively connected together by an idler or spur gear 159. The base 10 may include at least one detent 155*a* operatively connected with the at least one rotatable spool 153 to prevent a freewheeling of the at least one rotatable spool 153.

Windable strap 164 and associated strap 165 form a pair of straps and various views of straps 164, 165 are shown in FIGS. 2, 4 and 8. They extend out of rear wall 10*a* of the base 10 through slots or openings 10*b*, and carry male and female adjustable buckles 166 at their outer or free ends enabling the two straps 164, 165 to close about the back of a chair. As shown in FIG. 4, the female buckle is shown on the free end of strap 165 and the male buckle is shown on the free end of strap 164. This arrangement may be reversed. The other end of strap 165 is anchored to post 165*a* in the back of the housing 150 (see FIG. 8). The other end of strap 164 is anchored to post 157 in spool 153 through slot 158 so that it may be wound onto that spool 153 when strap 164 is to be retracted. Windable strap 169 and associated strap 168 form a pair of straps that are configured to secure the booster to the seat of, for instance, a chair and also straps 168, 169 carry two parts of a buckle 170. Straps 168, 169 extend out of separate side walls 10*c* through slots 10*d*, as shown in FIG. 8. Buckle 170 may be adjustable and have a male or female element at their outer ends, as shown in FIGS. 2 and 4. Straps 168, 169 are respectively anchored inside the housing 150 to fixed post 171*a* and post 157 of spool 153.

Figure 6:
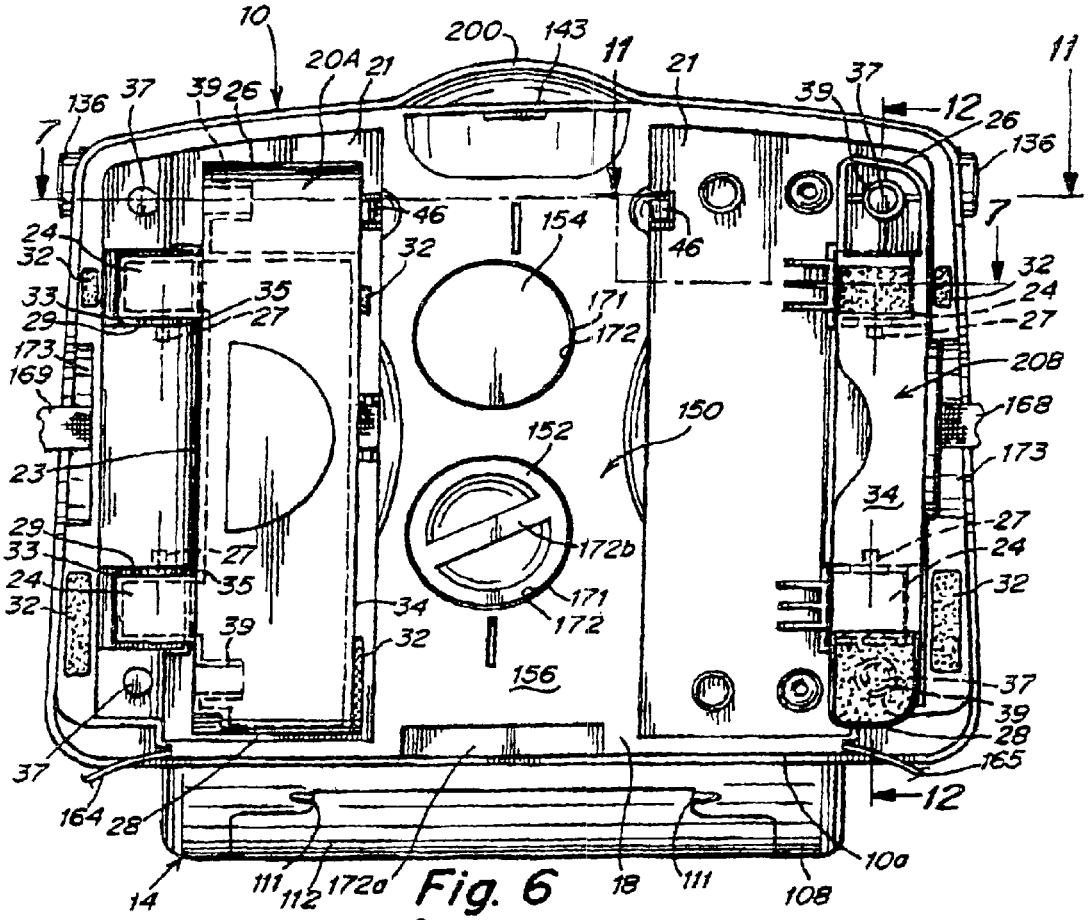
FIG. 6 is a bottom plan view of the booster seat with one leg extended and the other collapsed.

Openings 171 in the bottom wall 136 of the housing 150 are surrounded by upwardly extending flanges 172 that form seats for the spools 153 of retractors 152 and 154, and the retractors 152, 154 are exposed on or at the bottom of the base 10, as shown in FIGS. 6 and 9. Retractor 152 carries a handle 172*b* on its bottom for turning the spools 153 to retract the straps 164 and 169. It is apparent from FIG. 8 that when retractor 154 and its spool 153 are turned counterclockwise, as indicated by arrow 153*a*, its spool 153 will retract strap 169, and through idler gear 159 retractor 152 and its spool 153 will also turn and retract strap 164. Retractor 154 and its spool 153 could also be configured to turn clockwise, in the reverse of arrow 153*a*.

When the booster is to be strapped to a chair (see FIG. 1), straps 164 and 169 are fully extended (unwound from the spools 153) and wrapped around the back and seat of the chair, and the buckles 166 and 170, respectively are closed. The exposed portions of straps 165 and 168 are relatively short and extend out of the base 10 a short distance. Then by way of an adjustable portion of the buckle (the male portion of the buckle in the embodiment shown), the joined straps 164 and 165 and joined straps 168 and 169 can be tightened about the back and seat, respectively, of the chair. When the booster seat is to be removed, the buckles 166 and 170 are opened to free the booster seat, the male portions of the buckles are pulled to ends 164E', 169E' of their respective straps 164, 169, and the straps 164 and 169 are then retracted onto the spools 153 of retractors 152 and 154 by rotating handle 172*b*.

A recess 172*a* may be provided in the rear wall 10*a* of the base 10 for storing free ends of the straps 164 and 165 and the buckle 166 when not in use. Recesses 173 (see FIG. 2) on the sides of the base 10 are also available to store the buckle parts 170 and free ends of straps 168 and 169 when not in use.

It should be appreciated that while one specific embodiment of retractable straps or the strap retraction system has been described in detail, numerous equivalent structural alternatives may be possible. For example, each of the retractors 152, 154 with their spools 153 may be made to operate independently of the other by eliminating the spur or idler gear 159 and providing a handle 172*b* to rotate each spool 153 separately. When the tray 16 is placed on the base 10 as shown in FIGS. 3–5, the legs 20 along with the housing 150, handle 172*b* and buckle components 170 are enclosed, the buckles 170 being enclosed in recesses 173.

The booster seat may be provided with a harness 178 for retaining the child in the seat. Such an arrangement is shown in FIGS. 2, 7 and 9. The harness illustrated has a crotch strap 180 secured at its lower end to the underside of the seat 12, or the base 10. Additional straps 186 that extend out of the seating surface 50 through the slots 184 at the rear thereof or alternatively from the arms 52 of the seat 12 releasably connect to the top of the crotch strap 180 by means of buckles 190 and may extend over the shoulders and/or about the waist of the child. The child may readily be removed from the seat by opening the buckles 190. While one embodiment of the harness is shown, it is to be understood that a number of different types of harnesses may be used such as are widely used in booster seats, car seats, bouncers, high chairs, bassinets, etc.

In FIGS. 2 and 9, the booster seat is shown in its lower position for use by an older child and in FIG. 1 it is shown in its raised position for a younger child. In FIG. 3 the booster seat is shown in the stored configuration (with the exception of the lid 112) wherein the backrest 14 is folded down toward the seat surface 50 and disposed between the arms 52 and with the tray 16 attached to the base 10 on the bottom side thereof. The lid 112, however, is in the open position exposing the interior of the storage compartment 110 in the backrest 14. In FIG. 5 the booster seat is also shown in its collapsed configuration in position to be conveniently carried by its handle 200. It is apparent that the booster seat may be used without the tray 16, which is the usual configuration when placed on a chair adjacent a table for use by an older child.

Having described this booster seat in detail, those skilled in the art will appreciate that numerous modifications may be made of this disclosure without departing from its spirit. For example, the various means for attaching the several parts together such as the seat 12 to the base 10 and the backrest 14 to the seat 12 may be varied, and the manner in which the tray 16 and legs 20 attach to the seat 12 and base 10 may also take different forms. Moreover, many of the different aspects are useful independent of the others. The disclosure does not require that a booster seat incorporate all of the different aspects or all of the various features described. Therefore, it is not intended that the scope of the disclosure be limited to an embodiment including all of the many aspects and features described in connection with the specific booster seat illustrated. Rather the scope of the disclosure is to be determined by the appended claims and their equivalents.

Although the present disclosure has been described and illustrated in detail it is to be clearly understood that the same is by way of illustration and example only and is not to be taken by way of limitation. The spirit and scope of the present disclosure are to be limited only by the terms of the appended claims.

We claim:

1. A booster seat configured to carry a child and adapted to be supported by at least one of a chair and seat, the booster seat comprising a horizontally extending seat portion, at least one rotatable spool positioned to lie under the horizontally extending seat portion and rotate about a vertically extending axis of rotation, and at least one pair of straps having at least one strap windable about the at least one rotatable spool with the other strap of the at least one pair of straps configured to be connectable to the windable strap.

2. The booster seat of claim 1, wherein the at least one rotatable spool has a handle drivingly connected to the at least one rotatable spool for winding the at least one windable strap and the at least one rotatable spool is located between the seat portion and the handle.

3. The booster seat of claim 2, wherein the at least one windable strap is adapted to be wound essentially completely into the booster seat when not in use.

4. The booster seat of claim 1, wherein each strap of the at least one pair of straps has an anchored end inside the booster seat and a free end extending outside the booster seat.

5. The booster seat of claim 4, wherein the free ends have buckles to connect the at least one pair of straps together.

6. The booster seat of claim 5, wherein the at least one pair of straps are adapted to releasably secure the booster seat to one or more of a chair and seat upon which the booster seat is to be used.

7. The booster seat of claim 4, wherein the booster seat has recesses to store the free ends of the at least one pair of straps.

8. A booster seat configured to carry a child and adapted to be supported by at least one of a chair and seat, the booster seat comprising a seat portion, at least one rotatable spool, at least one pair of straps having at least one strap windable about the at least one rotatable spool with the other strap of the at least one pair of straps configured to be connectable to the windable strap, and a base portion connected to the seat portion, the base portion having a front, sides, and a rear wall, and wherein the at least one rotatable spool is mounted to the base portion to rotate about an upwardly extending axis intersecting the seat portion.

9. A booster seat configured to carry a child and adapted to be supported by at least one of a chair and seat, the booster seat comprising a seat portion, at least one pair of straps having at least one strap windable about the at least one rotatable spool with the other strap of the at least one pair of straps configured to be connectable to the windable strap, wherein the at least one rotatable spool includes two rotatable spools, each having an associated pair of straps, and each of the two rotatable spools is arranged to rotate about an upwardly extending axis intersecting the seat portion.

10. The booster seat of claim 9, further including a base portion connected to the seat portion, the base portion having a front, sides, and a rear wall, and wherein the two rotatable spools are mounted to the base portion and arranged to rotate about axes of rotation that are arranged to lie in spaced-apart relation to one another.

11. The booster seat of claim 10, wherein one of the two rotatable spools is mounted closer to the rear wall of the base portion than the other spool.

12. The booster seat of claim 9, wherein at least one of the rotatable spools has a handle drivingly connected to the at least one rotatable spool for winding its windable strap.

13. The booster seat of claim 12, wherein the rotatable spools are operatively connected together for simultaneously winding and simultaneously unwinding the windable strap on each rotatable spool.

14. The booster seat of claim 13, wherein the operative connection is a spur gear drivingly connected between the two rotatable spools.

15. The booster seat of claim 13, wherein the windable strap on each rotatable spool is adapted to be wound essentially completely into the booster seat when not in use.

16. The booster seat of claim 9, wherein the rotatable spools are operatively connected together for simultaneously winding and simultaneously unwinding the windable strap on each rotatable spool.

17. The booster seat of claim 16, wherein the operative connection is a spur gear drivingly connected between the two rotatable spools.

18. The booster seat of claim 9, wherein each strap of the two pairs of straps has an anchored end inside the booster seat and a free end outside the booster seat.

19. The booster seat of claim 18, wherein the free ends have buckles to connect the straps of each pair of associated straps together.

20. The booster seat of claim 19, wherein the two pair of straps are adapted to releasably secure the booster seat to one or more of a chair and seat upon which the booster seat is to be used.

21. The booster seat of claim 18, wherein the booster seat has recesses to store the free ends of the two pairs of straps.

22. A booster seat configured to carry a child and adapted to be supported by at least one of a chair and seat, the booster seat comprising a seat portion, a back portion, first and second rotatable spools, first and second pairs of straps, each strap having a first strap windable about a companion rotatable spool and a second stray configured to be connectable to the windable first strap, and a base portion connected to the seat portion, the base portion having a front, first and second sides, and a rear wall, and wherein the first and second rotatable spools are mounted to the base portion, the rear wall is arranged to lie adjacent to the back portion and is formed to include first and second opening, the first side is formed to include a third opening, the second side is formed to include a fourth opening, the first strap of the first pair of straps is coupled at one end to the first rotatable spool and arranged to pass through the first opening, the second strap of the first pair of straps is arranged to pass through the second opening, the first strap of the second pair of straps is coupled at one end to the second rotatable spool and arranged to pass through the third opening, and the second strap of the second pair of straps is arranged to pass through the fourth opening.

23. The booster seat of claim 22, wherein the first and second rotatable spools are arranged to lie in spaced-apart relation to one another under the seat portion.

24. The booster seat of claim 23, further comprising a first set of radially outwardly extending gear teeth coupled to the first rotatable spool, a second set of radially outwardly extending gear teeth coupled to the second rotatable spool, and an idler gear coupled to the first and second sets of radially outwardly extending gear teeth to transmit rotary motion from the first rotatable spool to the second rotatable spool.

25. The booster seat of claim 22, further comprising a handle coupled to the second rotatable spool to cause the second rotatable spool to lie between the seat portion and the handle and arranged to rotate the second rotatable spool about an axis of rotation intersecting the seat portion.

26. The booster seat of claim 22, further comprising strap winder means for rotating the first rotatable spool about a first axis of rotation intersecting the seat portion in response to rotation of the second rotatable spool about a second axis of rotation intersecting the seat portion and lying in spaced-part relation to the first axis of rotation.

27. The booster seat of claim 26, wherein the strap winder means includes a handle coupled to the second rotatable spool and the second rotatable spool is arranged to lie between the seat portion and the handle.

28. The booster seat of claim 26, wherein the strap winder means includes an idler gear and gear teeth coupled to the idler gear and to the first and second rotatable spools.

29. The booster seat of claim 22, further comprising a first post coupled to the base portion and to the second strap of the first pair of straps and a second post coupled to the base portion and to the second strap of the second pair of straps, and wherein the first and second posts are arranged to lie in spaced-apart relation to one another to locate the first and second rotatable spools therebetween.

30. A booster seat configured to carry a child and adapted to be supported by at least one of a chair and seat, the booster seat comprising a seat portion, a back portion, at least one rotatable spool positioned to lie under the seat portion, and at least one pair of straps having at least one strap windable about the at least one rotatable spool with the other strap of the at least one pair of straps configured to be connectable to the windable strap, and a handle drivingly connected to the at least one spool for winding the at least one windable strap, wherein the at least one spool is arranged to face downwardly in a direction away from the back portion and toward a chair or seat underlying the booster seat.

31. The booster seat of claim 30, wherein the at least one windable strap is adapted to be wound essentially completely into the booster seat when not in use.

32. The booster seat of claim 30, wherein the at least one rotatable spool includes two rotatable spools each having an associated pair of straps and the rotatable spools are operatively connected together for simultaneously winding and simultaneously unwinding the windable strap on each rotatable spool.

33. The booster seat of claim 30, wherein each strap of the two pairs of straps has an anchored end inside the booster seat and a free end outside the booster seat.

34. The booster seat of claim 33, wherein the free ends have buckles to connect the straps of each pair of associated straps together.

35. The booster seat of claim 34, wherein the booster seat has recesses to store the free ends of the two pairs of straps.

36. A booster seat comprising a seat portion, a base portion underlying the seat portion, the base being formed to include a downwardly opening retractor chamber, a first strap retractor coupled to the base and arranged to lie in the retractor chamber to be accessed upon movement of the base portion away from an underlying foundation, a first pair of straps, a first strap of the first pair of straps having an inner end coupled to the first strap retractor in the retractor chamber and an outer end located outside the retractor chamber and a second strap of the first pair of straps having an inner end coupled to the base in the retractor chamber and an outer end located outside the retractor chamber and configured to interlocking mate with the outer end of the first strap to anchor the booster seat in an anchored position on an underlying foundation.

37. The booster seat of claim 36, wherein the first retractor includes a first rotatable spool about which the first strap is wound, the inner end of the first strap is coupled to the first rotatable spool to rotate therewith, the base portion is formed to include first and second openings on a rear wall thereof, the first strap is arranged to pass through the first opening, and the second strap is arranged to pass through the second opening.

38. The booster seat of claim 37, wherein the base further includes a bottom wall and a first post coupled to the bottom wall and to the inner end of the second strap, the first rotatable spool is coupled to the bottom wall for rotation about a first axis of rotation, and the first post is located in a position between the first rotatable spool and the rear wall.

39. The booster seat of claim 37, further comprising a second strap retractor coupled to the base and a second pair of straps, a first strap of the second pair of straps having an inner end coupled to the second strap retractor, and a second strap of the second pair of straps having an inner end coupled to the base and an outer end located outside the base and configured to mate with the outer end of the first strap of the second pair of straps to anchor the booster seat in an anchored position on an underlying foundation.

40. The booster seat of claim 39, wherein the second retractor includes a second rotatable spool about which the first strap of the second pair of straps is wound, the inner end of the first strap of the second pair of straps is coupled to the second rotatable spool to rotate therewith, the base portion is formed to include a third opening in a first side thereof and a fourth opening in an opposite second side thereof, the first strap of the second pair of straps is arranged to pass through the third opening, and the second strap of the second pair of straps is arranged to pass through the fourth opening.

41. The booster seat of claim 40, wherein the base further includes a bottom wall and a second post coupled to the bottom wall and to the inner end of the second strap of the second pair of straps, the second rotatable spool is coupled to the bottom wall for rotation about a second axis of rotation, a first post is coupled to the bottom wall and to the inner end of the second strap of the first pair of straps, and the second rotatable spool is located between the first and second posts.

42. The booster seat of claim 36, further comprising a second strap retractor coupled to the base and a second pair of straps, a first strap of the second pair of straps having an inner end coupled to the second strap retractor, and a second strap of the second pair of straps having an inner end coupled to the base and an outer end located outside the base and configured to mate with the outer end of the first strap of the second pair of straps to anchor the booster seat in an anchored position on an underlying foundation.

43. The booster seat of claim 42, wherein the second refractor includes a second rotatable spool about which the first strap of the second pair of straps is wound, the inner end of the first strap of the second pair of straps is coupled to the second rotatable spool to rotate therewith, the base portion is formed to include a third opening in a first side thereof and a fourth opening in an opposite second side thereof, the first strap of the second pair of straps is arranged to pass through the third opening, and the second strap of the second pair of straps is arranged to pass through the fourth opening.

44. The booster seat of claim 43, wherein the base further includes a bottom wall and a second post coupled to the bottom wall and to the inner end of the second strap of the second pair of straps, the second rotatable spool is coupled to the bottom wall for rotation about a second axis of rotation, a first post is coupled to the bottom wall and to the inner end of the second strap of the first pair of straps, and the second rotatable spool is located between the first and second posts.

* * * * *